United States Patent [19]

Wahl

[11] Patent Number: 4,883,202

[45] Date of Patent: Nov. 28, 1989

[54] LIQUID PUMPING SYSTEM

[76] Inventor: Arthur A. Wahl, 6205 Broughton, St. Charles, Mich.

[21] Appl. No.: 146,197

[22] Filed: Jan. 20, 1988

[51] Int. Cl.[4] ..... B05G 1/28; B67D 5/40

[52] U.S. Cl. ..... 222/109; 222/131; 222/318; 222/375; 222/382; 222/383; 141/97; 239/120

[58] Field of Search ..... 222/108, 109, 110, 111, 222/318, 375, 372, 382, 383, 540, 180, 373, 131, 183, 424; 239/121, 120; 141/73, 97

[56] References Cited

U.S. PATENT DOCUMENTS

| | | | |
|---|---|---|---|
| 217,932 | 7/1879 | Field | 222/109 |
| 220,327 | 10/1879 | Aldrich | 222/109 |
| 234,411 | 11/1880 | Laverty | 222/109 |
| 248,378 | 10/1881 | Winfield | 222/109 X |
| 251,151 | 12/1881 | Winfield et al. | 222/109 X |
| 345,431 | 7/1886 | Hight | 222/109 |
| 483,757 | 10/1892 | Allgood . | |
| 653,499 | 7/1900 | Blanchard | 222/109 X |
| 1,170,726 | 2/1916 | Aycock | 222/109 |
| 1,705,392 | 3/1929 | Bohling | 222/382 |
| 1,744,925 | 1/1930 | Schroeder | 222/109 X |
| 2,692,704 | 10/1954 | Benz | 222/108 X |
| 2,730,958 | 1/1956 | Nelson | 222/109 X |
| 2,764,317 | 9/1956 | Lisciani | 222/109 |
| 3,069,671 | 12/1962 | Taylor | 222/108 X |
| 3,199,745 | 8/1965 | Hollis et al. . | |
| 3,205,176 | 9/1965 | Tenney . | |
| 3,799,440 | 3/1974 | Goss et al. | 222/108 X |
| 3,807,464 | 4/1974 | Pitesky | 141/97 |
| 3,833,156 | 9/1974 | Hough | 222/383 |
| 3,858,810 | 1/1975 | Seeley et al. | 239/121 |
| 3,891,122 | 6/1975 | Paranto | 222/372 X |
| 4,625,896 | 12/1986 | Rocchelli | 222/372 X |
| 4,630,759 | 12/1986 | Dawn | 222/372 X |
| 4,765,360 | 8/1988 | Baird | 222/108 X |

FOREIGN PATENT DOCUMENTS

| | | | |
|---|---|---|---|
| 266423 | of 0000 | United Kingdom | 222/109 |
| 259020 | 10/1926 | United Kingdom | 222/109 |
| 259737 | 10/1926 | United Kingdom | 222/109 |

*Primary Examiner*—Joseph J. Rolla
*Assistant Examiner*—Stephen B. Parker
*Attorney, Agent, or Firm*—John J. Swartz

[57] ABSTRACT

Anti-spill apparatus including a liquid recovery system, for use with a liquid pumping system, which recovers and returns to a liquid container, any liquid which is inadvertently emitted by the liquid pumping system. The apparatus contemplates a pump, having a feeder hose received in a liquid containing barrel, for conveying chemicals and the like contained in the barrel, to a remote location and a new mounting system for mounting the pump on the barrell. The recovery system includes a splash guard which encases a portion of the pump, a recovery hose coupled between a downstream portion of the feeder hose and the splash guard, and a drain spout which receives the liquid from the splash guard and conveys it to the liquid container.

25 Claims, 2 Drawing Sheets

LIQUID PUMPING SYSTEM

BACKGROUND OF THE INVENTION

Field of the Invention

This invention relates to a liquid pumping system, and more particularly, to anti-spill and liquid recovery apparatus for confining and recovering hazardous chemicals in a hazardous chemical pumping system.

Chemical feed systems are normally used in treating the water utilized in boilers, cooling towers and other similar equipment typically utilized in a coolant system. Such apparatus typically includes a conventional pump for pumping chemically treated make-up or replacement water from a liquid container to a coolant system.

The chemical is supplied in barrels and a meter-type chemical pump is typically utilized to feed the exact amount of make-up water and chemical to the system. Such pumps are normally set atop the barrel and include a feeder hose having a suction section inserted into the barrel.

The top wall of a typical chemical supply barrel has at least one strengthening ribs and recesses provided therein which presents an uneven resting surface for the pump. Accordingly, the pump would heretofore easily dislocate from its rest position and sometimes falls off the barrel and break. In addition to the expense of replacing the costly pump, this results in the spill of a hazardous chemical.

Another potentially dangerous condition arises in the prior art system if either through erosion, corrosion, or otherwise, the chemical supply feed hose ruptures. In addition to creating a hazard, the chemical, which pumps through the ruptured tube, will cause a great waste of expensive chemical.

Most chemicals are potentially hazardous. Some are hazardous because of physical reactions which can occur. Some chemicals are flammable which, if ignited, can cause burns.

In addition, such chemicals sometimes turn to gas and vapors and are thence pumped through a forced air heating system which further exascerbates the problem. Moreover, the chemicals will sometimes etch the floor material, sometimes are caustic substances which are dangerous to humans, and sometimes are carcinogens or suspected carcinogens which must be confined.

Corrosive materials, when splashed on skin and eyes, can cause injury to them. Most chemicals are irritating to the eyes and skin.

Some of the chemical agents are toxic and can cause injury or illness by entering the body and acting as a poison to one or more of the body systems. Usually, these materials are found in the workplace as vapors or gasses. They are carried by air to the breathing zone and into the body by way of the lungs. Some toxic materials can be absorbed through the skin and carried to other parts of the body.

Some materials are hazardous because they can reach with the environment in ways that hurt people such as flammable, reactive, radioactive, or pyrophoric materials. Other materials are hazardous because they cause illness or disease when they are taken into the body such as toxic, carcinogenic, or corrosive materials.

Accordingly, it is an object of the present invention to provide a new and novel system for confining and recovering liquids which are inadvertently emitted by a liquid pumping system.

It is a further object of the present invention to provide a new and novel mechanism for mounting a liquid pumping system atop a liquid container.

Another object of the present invention is to provide a new and novel pump mounting system including a mounting pan which spans a trough-like recess atop a liquid containing barrel.

Yet another object of the present invention is to provide a new and novel liquid confining and recovery system including a new and novel removeable splash enclosure guard which encases a portion of the pump and the liquid feeder hose.

Another object of the present invention is to provide a system of the type disclosed including a liquid recovery system which encompasses the feeder line and returns any inadvertently emitted liquid to the container from which it was pumped.

Although there is a no known prior art devices which contemplate the instant disclosure, the following prior art patents are cited as being of interest, although these patents do not disclose or remotely suggest applicant's disclosed and claimed construction.

| | | |
|---|---|---|
| 483,757 | C. B. Allgood | Oct. 4, 1892 |
| 2,692,704 | C. C. Benz | Oct. 26, 1954 |
| 3,069,671 | LeRoy M. Taylor | Dec. 18, 1962 |
| 3,199,745 | R. Hollis et al | Aug. 10, 1965 |
| 3,205,176 | W. L. Tenney | Sep. 7, 1965 |
| 3,799,440 | Goss et al | Mar. 26, 1974 |
| 3,858,810 | Seeley et al | Jan. 7, 1975 |

Other objects and advantages of the present invention will become apparent to those of ordinary skill in the art as the description thereof proceeds.

SUMMARY OF INVENTION

Apparatus for dispensing liquid from a liquid container comprising: a liquid pump; a feeder hose coupled to a portion of the pump for conveying liquid from the container to a remote location including a first hose section extending from the container to the pump and a second hose section extending from the pump to said remote location; and liquid recovery mechanism, enveloping a portion of the feeder hose and a portion of the pump, sealed to a downstream portion of the second hose section for confining and recovering any liquid inadvertently emitted from the feeder hose and directing same to the container.

The invention may be more readily understood by referring to the accompanying drawings, in which.

DESCRIPTION OF THE PREFERRED EMBODIMENT

Figure 1:
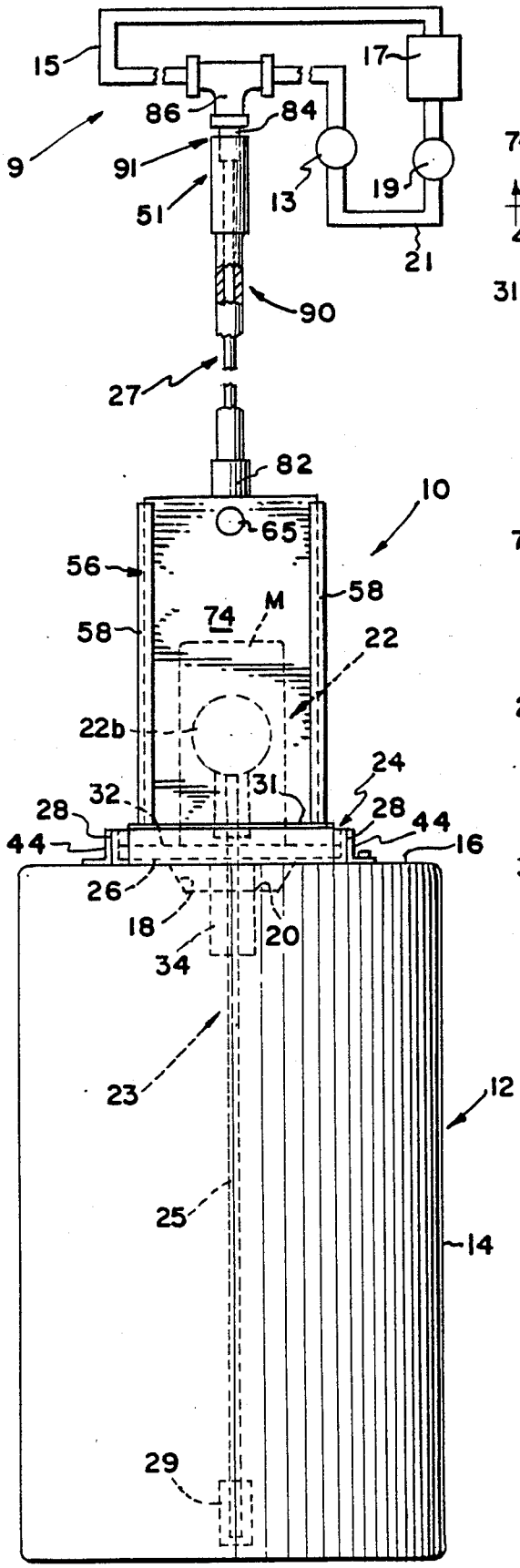
FIG. 1 is a front elevational view of apparatus constructed according to the present invention, part of the recovery hose being broken away to more clearly illustrate the feeder hose therein.
Figure 3:
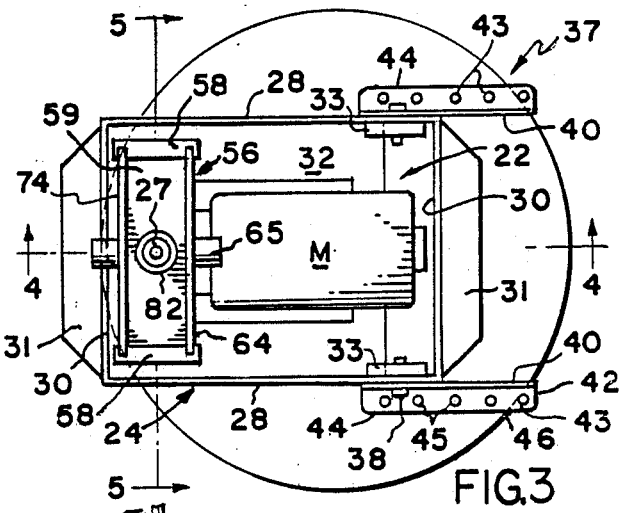
FIG. 3 is a top plan view of the apparatus illustrated in FIGS. 1 and 2.
Figure 2:
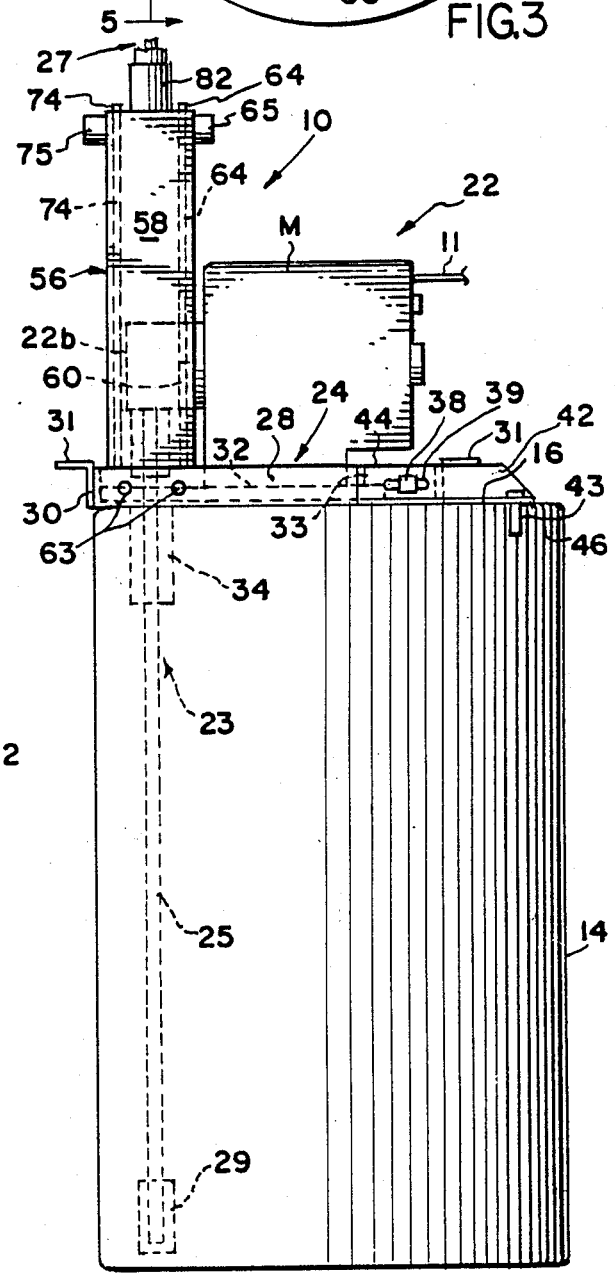
FIG. 2 is a side elevational view of the apparatus illustrated in FIG. 1.

Apparatus constructed according to the present invention, generally designated 10, is particularly adapted for use in pumping chemicals and/or make-up water from a chemical supply barrel, generally designated 12, having a side wall 14 and a top wall 16 provided with an elongate trough or recess 18 therein. An aperture 20 is provided in the base of the trough 18 through which the make-up water, hazardous chemical, or other liquid contained in barrel 12 is pumped.

The apparatus constructed according to the present invention is particularly adapted for use in pumping the chemically treated make-up or replacement water and chemical from the barrel 12 to a coolant system, generally designated 9, which typically includes a conventional recirculating pump 13, which pumps liquid via a conduit 15, to a cooling tower or the like 17. The liquid is then condensed via a condensor 19 and returned via a line 21 to the recirculating pump 13.

A metered liquid chemical pump, generally designated 22, is provided for pumping liquid from the barrel 12 via a feeder hose, generally designated 23, including a suction hose section 25 which is received in the top barrel aperture 20. The pump 22 is of conventional construction and includes an electric motor M connected to a suitable source of power such as 110 volt, 60 KHZ power via an electric cord 11. The motor M drives an internally disposed impeller (not shown) mounted within a pump section **22*b*, as usual, for sucking liquid via tube 25 out of the barrel 12 and thence outwardly through a second supply feeder hose section 27, coupled to the impeller section 22*b*, to the coolant system 9**.

A foot or check-valve 29 is attached to the lower end of suction tube 25 to prevent the pump 22 from losing its prime. The depression, trough or recess 18 in the barrel top wall 16 adds strength to the barrel top wall 16 but provides an uneven upper mounting surface for the pump 22.

Apparatus for mounting the pump 22 atop the barrel 12 includes an upwardly opening pump mounting drain pan, generally designated 24, including a bottom wall 26, sidewalls 28 and end walls 30. As illustrated in FIG. 1, the bottom wall 26 is of sufficient width so as to span the upper open end of the trough 18. The pump 22 may suitably comprise a commercially available pump such as that manufactured by Precision Control Products, Meridian, Conn., as Model No. 10681-361 having a capacity of 75 PSI.

Figure 4:
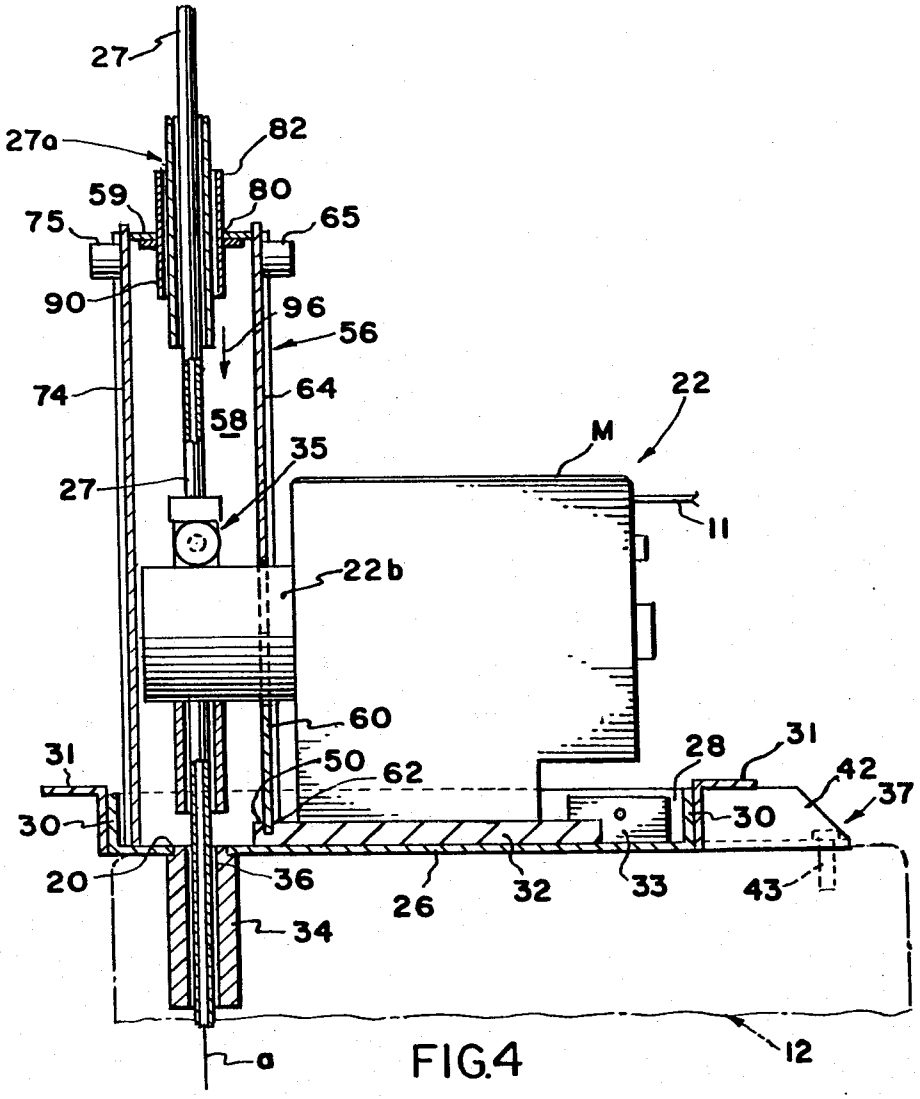
FIG. 4 is an enlarged sectional side view taken along the line of 4—4 of FIG. 3.

The pump 22 is bolted or otherwise suitably fixed to a base 32 which typically has a width that approximates the width of the upper end of the trough 18. The metered chemical pump 22 automatically feeds the proper amount of chemical into the feed system 9 and may include a pump primer 35 (FIG. 4). If desired, a suitable computer control system (not shown) can be utilized to insure that a suitable and proper amount of chemical is fed by chemical pump 22 to the cooling system 9.

Integrally connected with the drain pan end walls 30 are horizontal handles 31 which may be manually grasped to transfer the drain pan 24 and pump 22 to and from the chemical barrel 12 without the necessity of touching the pump 22 which is usually covered with hazardous chemicals. The drain pan 24 may suitably comprise chemically resistant PVC plastic material.

Depending from the underside of the bottom pan wall 26, in liquid communication with an opening 36 therein, is a drain spout 34 having a vertical axis a. The drain spout 34 is received in the upper barrel wall aperture 20 to return chemical spillage in the pan 24 to barrel 12 and thus prevent any inadvertently spilled chemicals from reaching the floor.

The pump base 32 is held in position via a pair of hold-down bars 33 (FIG. 4) releasably mounted on the inside surfaces of pan sidewalls 28 via suitable bolts 38 which pass through apertures in the pan sidewalls 28.

Anti-rotation mechanism, generally designated 37, is provided for securing the pan and precluding its rotation about the vertical axes a of the drain spout 34. The anti-rotating mechanism 37 includes a pair of L-shaped safety clips 42 mounted on the pan sidewalls opposite the hold down bars 33. The safety clips 42 include upstanding legs 40 having elongate slots which receive the bolts 38. Anti-rotation pins 43 disposed in any one of a plurality of longitudinally spaced holes 45 provided in the horizontal base 44 of safety clips 42 for engaging the upper, peripherally outer, upper barrel surface 46 of barrel 12. The elongate slots 39 allow finite longitudinal adjustment of clips 42 such that the anti-rotation pins 43, depending from the base 44 of safety clips 42, will snugly engage the peripherally outer upper surface 46 of the barrel 12. With the spout 34 received in the container opening 20 and the anti-rotation pins 43 engaging the outer barrel surface 46, the device 10 will be precluded from rotating about the axis a of drain spout 34 and barrel aperture 20.

Fixed to the front of the pump holding splash pan 24 is a splash enclosure guard frame, generally designated 56, including a pair of upstanding sidewalls 58 spanned by a lower rear wall member 60 and an upper top wall 59. The lower rear wall member 60 includes a notch 62 in the central lower edge thereof for receiving and releasably securing an upper front portion 50 of the pump base 32. The lower rear wall member 60 includes an upper edge 70 provided with a central semi-circular notch 61 which conforms to the shape of the underside of impeller mounting section **22*b***.

Figure 5:
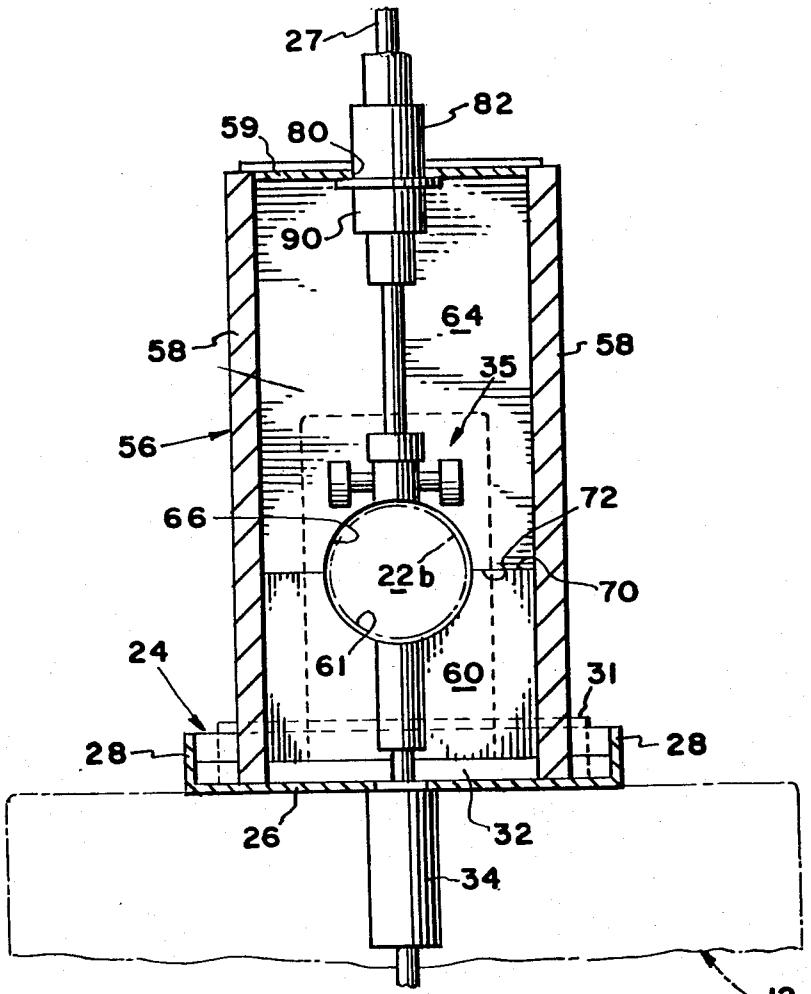
FIG. 5 is an enlarged sectional end view, taken along the line 5—5 of FIG. 3.

The splash enclosure guard frame 56 also includes a vertically removable, upper rear plate 64 which includes a central cut-out 66 in the lower central portion thereof for conforming to the shape of the impeller mounting pump portion **22*b* with which, in the lowered position illustrated in the drawing, it engages. In the lowered position, as illustrated in FIG. 5, the upper edge 70 of lower plate 60 and lower edge surface 72 of upper rear plate 64** are in abutting engagement.

A removable front closure plate 74 is provided at the front of splash guard frame 56 and is vertically moveable, between the lowered, operative position, illustrated in FIG. 4, and an inoperative, elevated position to provide access to the internally disposed pump portion **22*b* as necessary. Handles 65 and 75 are provided on the front and rear plates 64 and 74**, respectively, to aid the movement thereof.

The enclosure frame guard 56 provides an enclosure to help prevent chemical vapors of any chemical disposed therein from evaporating to atmosphere.

The splash enclosure guard frame 56 may suitably comprise PVC plastic whereas the front panel 74 may be translucent PVC plastic to enable the operator to visually inspect the internally disposed pump portion **22*b*. The splash guard sidewalls 58 may be connected to the drain pan sidewalls 28 via bolts 63**.

The enclosure guard top wall 59 includes an aperture 80 having a open ended vertical sleeve 82 snugly received thereby and secured therein.

One end **27*a* of chemical supply hose section 27 is received by the sleeve 82 and the opposite hose end 51 is coupled to an anti-siphon valve 84 which is threadedly connected to a T-coupling 86 connected in the coolant system 9. The anti-siphon or check valve 84 precludes liquid in the water distribution system 9 from returning to the tube liquid supply system line 27, however, it allows chemical being pumped by pump 22 to be dispensed to the coolant system line 15**.

The liquid supply section hose 27 is disposed within an enlarged diameter flexible confining and recovery hose, generally designated 90, received, at its lower end, in the splash guard sleeve 82 and has its upper end 91 sealed to the valve 84. If the feeder hose 27 fractures and liquid chemical, under pressure, exudes outwardly therethrough, the outer tube 90 will confine the liquid chemical and return it to the splash guard 56 and pan 24 for passage through the drain tube 34 to the barrel 12.

THE OPERATION

The pump 22 is coupled to the drain pan 24 via the hold-down bars 32 and the lower rear splash guard plate 60 which receives and secures the front pump base portion 50. The user disposes the pan assembly 24, having the pump 22 mounted thereon, in the position illustrated in the drawings wherein the drain spout 34 is received in the upper barrel aperture opening 20 provided in the barrel top wall 16. The anti-rotation pins 43 are adjusted so that they are snuggly bear against the outer, upper surface 46 of the barrel sidewall 12. When water in the cooling system 13, 15, 17, 19 and 21 evaporates, the pump 22 operates to pump liquid from barrel 12 through suction hose 25 and feed hose section 27, and check valve 84 to coolant system line 15.

In the event that the supply hose 27 ruptures, liquid escaping therethrough will be confined by the upper sealed recovery hose end 91 and will thus move, via gravity, downwardly in the direction of the arrow 96 between the feeder tube 27 and containing tube 90 and thence through the splash guard 56 and onto the drain pan 22 for return to the barrel 12 via the spout 34.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for dispensing liquid from a liquid container comprising a liquid pump;

a feeder hose coupled to a portion of said pump for conveying liquid from said container to a remote location including a first hose section extending from said container to said pump and a second hose section extending from said pump to said remote location; and liquid recovery means enveloping said feeder hose and said portion of said pump and sealed to a downstream portion of said second hose section for confining and recovering any liquid inadvertently emitted from said feeder hose and directing same to said container.

2. The apparatus set forth in claim 1 said liquid recovery means includes apparatus for mounting the pump comprising an upwardly opening pan having a bottom wall supporting said pump and a generally upstanding sidewall;

an opening in said bottom wall; and a spout depending from said bottom wall in liquid communication with said bottom wall opening and said container.

3. The apparatus set forth in claim 2 including means for inhibiting rotation of said apparatus about the axis of said spout.

4. The apparatus set forth in claim 3 wherein said liquid recovery means includes a splash guard extending upwardly from said bottom wall and including a portion overlying said pump portion, said splash guard including an aperture therein receiving said second hose section.

5. The apparatus set forth in claim 4 wherein said liquid recovery means includes a liquid recovery hose received by said aperture and includes a downstream portion sealed to said downstream portion of said second hose section.

6. The apparatus set forth in claim 5 wherein said splash guard includes front and back walls spanned by end walls and a top wall, at least one of said front and backwalls being detachably mounted to allow access to said pump.

7. The apparatus set forth in claim 3 wherein said means for inhibiting rotation depends from said bottom wall.

8. The apparatus set forth in claim 7 wherein said means for inhibiting rotation includes a plurality of spaced apart legs depending from said bottom wall for engaging circumferentially spaced apart sidewall portions of said barrel.

9. The apparatus set forth in claim 1 wherein said liquid recovery means includes a liquid recovery hose including a downstream portion sealed to said downstream portion of said second hose section.

10. The apparatus set forth in claim 1 wherein said liquid recovery means includes a splash guard including a portion overlying said pump portion, said splash guard including an aperture therein receiving said second hose section.

11. The apparatus set forth in claim 10 wherein said splash guard comprises a hollow cover including a front wall, back wall and side walls spanning said front and back walls and a top wall spanning said front wall, back wall and side walls, and means for detachably mounting at least one of said front and back walls to allow access for removal of said pump.

12. The apparatus set forth in claim 11 wherein said back wall includes a recess in the lower end thereof for receiving a portion of said pump.

13. The apparatus set forth in claim 10 wherein said aperture is provided in said top wall.

14. In combination with a container having a sidewall spanned by a top wall which includes a trough therein and an opening therethrough, apparatus for removing liquid from said container comprising;

apparatus for mounting a chemical dispensing pump on said topwall including:

a combination pump base and drain pan having a bottom wall of sufficient width to span said trough;

a drain spout depending from said bottom wall received in said top wall opening;

means for detachably mounting a chemical pump on said bottom wall; and means mounted on said combination pump base and drain pan for engaging circumferentially spaced portions of said container to inhibit rotation of said pan about said drain spout;

said means for inhibiting rotation including a plurality of spaced apart legs depending from said bottom wall for engaging circumferentially spaced apart sidewall portions of said barrel;

a splash guard, communicating with said drain spout, extending upwardly from said bottom wall and having a portion overlying a portion of said pump;

said guard being provided with an aperture therethrough;

a feeder hose coupled to said pump extending from within said barrel through said opening and through said aperture; and a liquid recovery hose in fluid communication with said aperture and enveloping said feeder hose for recovering any liquid inadvertently emitted from said feeder hose.

15. The apparatus set forth in claim 14 wherein a hollow sleeve is mounted on said splash guard in fluid communication with said aperture for receiving said liquid recovery hose and said feeder hose.

16. The apparatus set forth in claim 14 wherein said splash guard comprises a hollow cover including front wall, back wall and side walls spanning said front and back walls and a top wall spanning said front wall, back wall and side walls, and means for detachably mounting at least one of said front and back walls.

17. Apparatus for removing liquid from a container having a sidewall spanned by a topwall which includes an opening therethrough comprising:

a chemical dispensing pump;

apparatus for mounting said chemical dispensing pump on said topwall including:

a combination pump base and drain pan having a bottom wall;

a drain spout depending from said bottom wall for being received in said top wall opening;

means for detachably mounting said chemical pump on said bottom wall;

a splash guard, communicating with said drain spout, extending upwardly from said bottom wall and having a portion overlying a portion of said pump;

said guard being provided with an aperture therethrough;

a feeder hose coupled to said pump extending from within said container through said opening and through said aperture; and a liquid recovery hose in fluid communication with said aperture and enveloping said feeder hose for recovering any liquid inadvertently emitted from said feeder hose;

said splash guard comprising a hollow cover including a front wall, back wall and side walls spanning said front and back walls and a top wall spanning said front wall, back wall and side walls, and means for detachably mounting at least one of said front and back walls to allow access for removal of said pump.

18. The apparatus set forth in claim 17 wherein said back wall includes a recess in the lower end thereof for receiving a portion of said pump.

19. The apparatus set forth in claim 17 wherein said aperture is provided in said top wall.

20. The apparatus set forth in claim 19 wherein said liquid recovery hose is received by said aperture and is sealed to a downstream portion of said feeder hose.

21. The apparatus set forth in claim 20 wherein a hollow sleeve is mounted on said top wall in fluid communication with said aperture for receiving said liquid recovery hose and said feeder hose.

22. The apparatus set forth in claim 17 including means mounted on said pump base and drain pan for engaging circumferentially spaced portions of said container to inhibit rotation of said pan about said drain spout.

23. The apparatus set forth in claim 22 wherein said means for inhibiting rotation depends from said bottom wall.

24. The apparatus set forth in claim 23 wherein said means for inhibiting rotation includes a plurality of spaced apart legs depending from said bottom wall for engaging circumferentially spaced apart sidewall portions of said barrel.

25. The apparatus set forth in claim 17 wherein said second hose section extends through said top wall; each portion of said second hose section being at a lower level than each other portion of second hose section downstream thereof.

* * * * *